US011482347B2

(12) United States Patent
Takatsuka

(10) Patent No.: US 11,482,347 B2
(45) Date of Patent: Oct. 25, 2022

(54) METHOD FOR DECONTAMINATING TRITIUM RADIOACTIVE CONTAMINATED WATER

(71) Applicant: KABUSHIKIKAISHA GABRIEL, Tokyo (JP)

(72) Inventor: Hikaru Takatsuka, Tokyo (JP)

(73) Assignee: KABUSHIKIKAISHA GABRIEL, Tokyo (JP)

( * ) Notice: Subject to any disclaimer, the term of this patent is extended or adjusted under 35 U.S.C. 154(b) by 0 days.

(21) Appl. No.: 17/607,043

(22) PCT Filed: Sep. 30, 2019

(86) PCT No.: PCT/JP2019/038567
§ 371 (c)(1),
(2) Date: Oct. 28, 2021

(87) PCT Pub. No.: WO2021/064806
PCT Pub. Date: Apr. 8, 2021

(65) Prior Publication Data
US 2022/0148750 A1 May 12, 2022

(51) Int. Cl.
*G21F 9/12* (2006.01)

(52) U.S. Cl.
CPC ..... *G21F 9/12* (2013.01)

(58) Field of Classification Search
CPC ..... G21F 9/06
See application file for complete search history.

(56) References Cited

FOREIGN PATENT DOCUMENTS

| | | |
|---|---|---|
| JP | 2011-230038 | 11/2011 |
| JP | 2016-193407 | 11/2016 |
| JP | 2017-504785 | 2/2017 |
| JP | 2019-28001 | 2/2019 |
| JP | 2019-35735 | 3/2019 |
| WO | 2016199800 | 12/2016 |

OTHER PUBLICATIONS

"International Search Report (Form PCT/ISA/210) of PCT/JP2019/038567", dated Jan. 7, 2020, with English translation thereof, pp. 1-4.

*Primary Examiner* — Dirk R Bass
(74) *Attorney, Agent, or Firm* — JCIPRNET

(57) ABSTRACT

A decontamination method in which tritium radiation is attenuated or eliminated from radioactive contaminated water. In the decontamination method, the following steps are executed: a step for performing an addition treatment to add a prescribed amount of a mineral powder such as a silicon dioxide ore and a nano-level carbon liquid to heated tritium-contaminated water in an addition treatment tank; a step for pumping the addition-treated water from the addition treatment tank to a mineral solid filled tank using a hydraulic pump; a step for causing the addition-treated water to collide with a mineral solid and passing the addition-treated water through the mineral solid filled tank; a step for returning the passed water to the addition treatment tank using the hydraulic pump; and a circulation process step for repeating the aforementioned steps in a prescribed period of time.

16 Claims, 1 Drawing Sheet

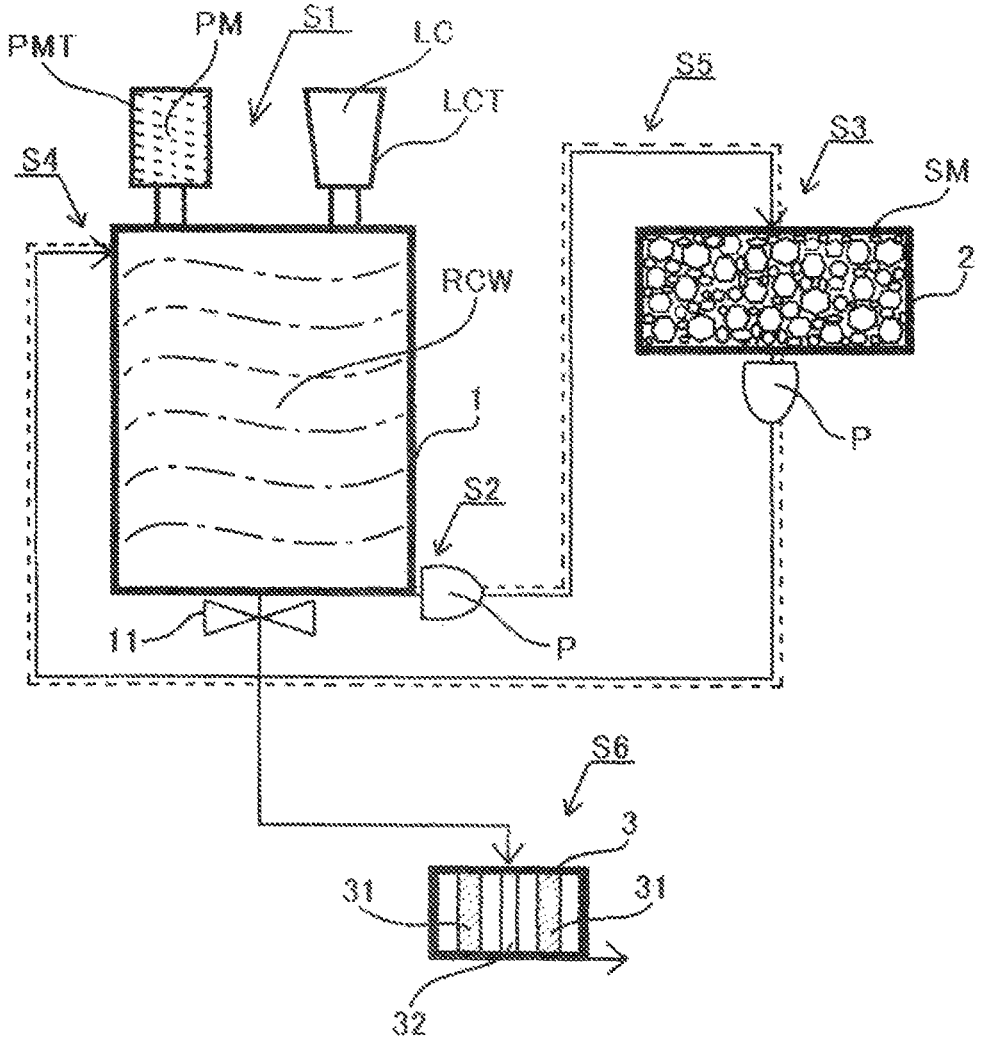
PMT
PM
S1
LC
LCT
S5
S3
S4
SM
2
RCW
1
P
S2
11
P
S6
3
31
31
32

METHOD FOR DECONTAMINATING TRITIUM RADIOACTIVE CONTAMINATED WATER

CROSS-REFERENCE TO RELATED APPLICATION

This application is a 371 application of the international PCT application serial no. PCT/JP2019/038567, filed on Sep. 30, 2019. The entirety of each of the above—mentioned patent applications is hereby incorporated by reference herein and made a part of this specification.

TECHNICAL FIELD

The present invention relates to a decontamination method of decreasing or removing tritium radiation from radioactive contaminated water that is contaminated by radioactive substances, particularly tritium.

BACKGROUND ART

Tritium is a radioactive material that emits beta-rays, and has radioactivity, that is, ability to emit radiation, which is one of electromagnetic wave or particle beam, in the same manner as cesium or strontium. As a unit showing the amount of radioactivity, becquerel [Bq] is used, and the ability of one nucleus to collapse for one second is expressed as 1 becquerel [Bq]. Further, gray, roentgen, or the like is used as a unit of radiation dose, while sievert [Sv] is used as a unit representing exposure dose to a living body. Radiation results in a recovery difficult damage to skin, various organs, cells, and the like of human and animals.

Radioactive concentration of cesium and strontium in radioactive contaminated water generated due to a nuclear power plant accident is reduced by an advanced liquid processing system and the like. In addition, most of the radioactive materials other than tritium can be removed from the radioactive contaminated water. However, there is no effective means for removing tritium from the contaminated water, and tritium remains in the contaminated water. Although countermeasures such as dilution of tritium-contaminated water and discharging to the ocean are discussed, it is necessary to protect the marine environment from marine contamination and cannot be dumped at sea. Therefore, tritium-contaminated water is stored in tanks and the storage tanks continue to increase. As the tank storage amount of tritium-contaminated water exceeds 1,000,000 tons, an effective means for removing tritium radiation from contaminated water is strongly demanded.

Patent Document 1 discloses a method for treating tritium-containing contaminated water, in which a large amount of contaminated water containing tritium can be reduced in volume at a practical level. In this treatment method, tritium-containing contaminated water is absorbed by a water-absorbing polymer in the presence of a carbohydrate as necessary. The water content of the water-containing and water-absorbing polymer is evaporated or distilled at a low temperature of 80° C. or lower, and the tritium water in the contaminated water is concentrated in the water-absorbing polymer. The concentrated water-containing and water-absorbing polymer in which tritium water is concentrated is stored in containers for a certain period to make it harmless.

Patent Document 2 discloses a tritium decomposing and detoxifying apparatus and system for removing tritium from radioactive contaminated water. The tritium decomposing and detoxifying apparatus includes a body member and a passage portion formed on the body member for radioactive contaminated water. An alpha-ray radiator is disposed inside the passage portion to decompose tritium in radioactive contaminated water containing tritium. The treatment methods and apparatus proposed in these Patent Documents 1 and 2 do not exhibit an effective decontamination function on tritium contaminated water.

PRIOR ART DOCUMENTS

Patent Documents

Patent Document 1: JP 2019-35735 A
Patent Document 2: JP 2019-28001 A

SUMMARY OF INVENTION

Problems to be Solved by Invention

The present invention provides a decontamination method for reducing or removing tritium radiation from radioactive contaminated water contaminated by tritium.

Means for Solving the Problems

A tritium radioactive contaminated water decontamination method of reducing or removing tritium radiation from radioactive contaminated water, the method comprising the steps of: a first step (S1) of performing an addition treatment in an addition treatment tank 1, the addition treatment including adding 0.5-6 parts by weight of mineral powder PM obtained by pulverizing one or more minerals selected from silicon dioxide ore, old shellfish fossil or radium ore, and 0.5-6 parts by weight of a nano-level carbon liquid to 100 parts by weight of tritium radioactive contaminated water RCW heated to 30-80° C.; a second step (S2) of pumping the addition treated water from the addition treatment tank to a mineral solid filled tank 2 by a hydraulic pump P of 1-7 atmosphere pressure, the mineral solid filled tank being filled with a mineral solid SM including the mineral crushed to a predetermined size; a third step (S3) of passing the pumped addition treated water through the mineral solid filled tank, while the pumped addition treated water is colliding with the mineral solid; a fourth step (S4) of returning the treated water passed through the mineral solid filled tank to the addition treatment tank by the hydraulic pump; and a fifth step (S5) of performing a circulation process of repeating the second step (S2) to the fourth step (S4) for 20 to 80 minutes.

In the present invention, the first step (S1) to the fifth step (S5) may be performed for 10-60 minutes, and thereafter, the mineral powder PM and nano-level carbon liquid LC addition treatment in the first step (S1) of adding 0.5-6 parts by weight of the mineral powder and 0.5-6 parts by weight of the nano-level carbon liquid to 100 parts by weight of the tritium radioactive contaminated water may be further performed, and thereafter, the second step (S2) and the subsequent steps may be performed for 10-60 minutes. Further, a series of the first step (S1) to the fifth step (S5) may be repeated until a desired tritium radioactive concentration is obtained.

The tritium radioactive contaminated water decontamination method according to the present invention may reduce or remove tritium radiation from radioactive contaminated water by a sixth step (S6) of introducing a predetermined amount of the decontamination treated water to which a series of the first step (S1) to the fifth step (S5) are executed into an electrolytic cell (3) in which 2-30 rod-like or plate-like electrodes (31) are arranged and performing electrolytic treatment for 10-30 hours.

In the present invention, the electrolytic treatment may be carried out until electrolytic treatment water in the electrolytic cell reaches a non-conducting state. The electrodes (31) arranged in the electrolytic cell may be iron electrodes, stainless steel electrodes or platinum electrodes. Further, the electrodes (31) may include two or three selected from iron electrodes, stainless steel electrodes and platinum electrodes. The electrolytic treatment may be carried out by applying an alternating current of 100 to 500 V to the electrodes. The electrolytic treatment may be repeatedly performed until a desired tritium radioactive concentration is obtained. The mineral powder PM may be agitated by a stirring device and extruded into the addition treatment tank 1.

Effect of Invention

The decontamination method according to the present invention can be realized at a relatively low cost without requiring a large scale facility because of use of an easily available mineral such as a silicon dioxide ore and a nano-level carbon liquid. Since tritium radiation of the treated water after the decontamination treatment by the decontamination method according to the present invention has been reduced, water drain to the sea can be performed without causing marine pollution.

BRIEF DESCRIPTION OF DRAWING

FIGURE is a conceptual diagram showing a configuration example for a decontamination method of tritium contaminated water according to the present invention.

DESCRIPTION OF PREFERRED EMBODIMENTS

A decontamination method of decontaminating tritium radioactive contaminated water according to the present invention (hereinafter referred to as "the present decontamination method") will be described with reference to FIGURE. A first aspect of the present decontamination method or the first decontamination method comprises the steps of: a first step (hereinafter referred to as "S1") of performing an addition treatment including adding a mineral powder PM and a nano-level carbon liquid LC (hereinafter referred to as "carbon liquid") to tritium radioactive contaminated water RCW (hereinafter referred to as "contaminated water"); a second step (hereinafter referred to as "S2") of pumping the addition treated water to a mineral solid filled tank 2; a third step (hereinafter referred to as "S3") of passing the addition treated water through the mineral solid filled tank; a fourth step (hereinafter referred to as "S4") of returning the passed treated water to the addition treatment tank; and a fifth step (hereinafter referred to as "S5") of performing a circulation process of repeating the steps S2 to S4.

In a decontamination process for carrying out the present decontamination method, the contaminated water RCW is charged into the addition treatment tank 1, and the mineral powder PM is stored in a mineral powder storage tank PMT, and the carbon liquid LC is accommodated in a carbon liquid storage tank LCT. The mineral solid SM is filled in a mineral solid filled tank 2.

The contaminated water is heated to 30 to 80° C. [degrees Celsius], preferably 40 to 80° C. depending on the outside air temperature. The temperature of the contaminated water may be ambient temperature, i.e., temperature of about 15° C. to 25° C. without cooling or heating the contaminated water. The amount of the mineral powder and the carbon liquid to be added to the contaminated water is 0.5 to 6 parts by weight, preferably 1 to 5 parts by weight, relative to 100 parts by weight of the contaminated water. In the addition treatment tank 1, the mineral powder and the carbon liquid are added to the contaminated water. The mineral powder and the carbon liquid added to the contaminated water are agitated and mixed with the contaminated water in the addition treatment tank by water flow by a hydraulic or water-pressure pump. Instead, they may be mixed and agitated in the addition treatment tank after the addition.

In the present invention, the mineral powder is obtained by pulverizing the mineral by a crusher to form a powdery state. The mineral powder is stirred in the mineral powder storage tank PMT and extruded into the addition processing tank 1 to be added to the contaminated water. The carbon liquid LC stored in the carbon liquid storage tank LCT falls into the addition treatment tank 1 and is added to the contaminated water. The mineral powder and the carbon liquid can be added to the contaminated water in a shower form by an injection device.

Silicon dioxide ore or mineral is commonly referred to as black silica. In the present invention, natural black silica having an anion (minus ion) is used as the silicon dioxide ore. The old shellfish fossil used in the present invention is generally referred to as somatid. The old shellfish fossil was formed by the surface uplift and land formation so that the old sea shellfish was deposited in the land, which has an anion (minus ion). Although the radium ore or mineral is typically mass 226 radium, ore containing mass 223, 224, or 228 radium can be also used in the present invention. In the present invention, natural radium ore having an anion (minus ion) as a radium ore can be used.

As the mineral, one mineral selected from silicon dioxide ore, old shellfish fossil or radium ore can be used solely. Alternatively, minerals having two or more selected from these minerals can be used.

The nano-level carbon is produced by firing chaff, grass, flower, or tree at 400-1200° C. in a substantial oxygen-free state, and pulverizing it to 0.1 mm-$0.1^{-9}$ mm. The pulverized nano-carbon is mixed into purified water from which impurities such as chlorine are removed to form liquid nano-level carbon. In the present invention, "KMK carbon liquid" (registered trademark) manufactured and commercially available by Environmental Technology Co., Ltd. can be used as the liquid nano-level carbon, which is a nano-level carbon solution from a plant as a raw material. The KMK carbon solution will encapsulate the radioactive material, absorb electromagnetic waves of the radioactive material and radiate as thermal energy, thereby reducing the radioactive concentration.

The water pressure of the pump P used in the first decontamination method is about one atmospheric pressure (atm) used for the general tap water. Alternatively, the water pressure can be set to 2-7 atm depending on the scale of the apparatus. The hydraulic pump is used to forcibly feed or pump the addition treated water in S1 from the addition treatment tank 1 to the mineral solid filled tank 2. The mineral solid SM filled or replenished in the mineral solid filled tank is crushed into crushed stones having a size of about 1 to 4 cm.

Subsequently, the addition treated water pumped into the mineral solid filled tank 2 is passed through the mineral solid filled tank while colliding with the mineral solid SM (S3). When the addition treated water is passed through the mineral solid filled tank, the mineral solid filled in the mineral solid filled tank collides with each other by the water flow of the hydraulic pump to generate a high voltage electric current.

Thereafter, the treated water passed through the mineral solid filled tank is returned to the addition treatment tank using the hydraulic pump (S4). Depending on the amount of the treated contaminated water and the scale of the apparatus, a circulation process including the steps S2 to S4 is repeated for 20 to 80 minutes, preferably about 30 to 70 minutes (S5). By performing the steps S1 to S5, the tritium radiation can be reduced or removed from the radioactive contaminated water. In the repeated circulation process in S5, the mineral powder and the carbon liquid may be not added. Instead, the mineral powder and the carbon liquid may be added after a series of steps S1 to S5 are completed and when next contaminated water treatment is performed.

In the present invention, the mineral powder and the carbon liquid may be added in the middle of executing the steps S1 to S5 for about 20 to 80 minutes and then a series of the steps may be performed again. After the series of the steps S1 to S5 are executed for 10 to 60 minutes, 0.5 to 6 parts by weight of the mineral powder and the carbon liquid are added to 100 parts by weight of the contaminated water, respectively, and the steps S2 to S5 are continued for 10 to 60 minutes.

In the present invention, the series of the steps S1 to S5 may be repeated until a desired tritium radioactive concentration (hereinafter referred to as "tritium concentration") is obtained. The series of the steps of S1 to S5 are carried out repeatedly until a level of the tritium concentration reaches a level in which there is no possibility of exposure to people, organisms, etc. based on a scientific basis and the safety of discharge to the ocean or river is secured, or a level in which reputation damage and the like due to radiation contamination disappears and the agreement of local residents is obtained.

Next, a second aspect of the present decontamination method or the second decontamination method will be described with reference to FIGURE. The second decontamination method includes a step of performing an electrolytic treatment (hereinafter referred to as "S6") to the decontamination treated water processed by the steps S1 to S5 of the first decontamination method. Since the decontamination treatment of S1 to S5 is the same as those of the first decontamination method, the electrolytic treatment related to the second decontamination method will be described in detail below. In the second decontamination method, if tritium remains even after the treatment of S1 to S5 has been carried out, the decontamination treated water obtained by the series of the steps S1 to S5 is introduced into the electrolytic cell to perform the electrolytic treatment in order to remove or eliminate the residual tritium.

Even if the residual radiation after the step S6 in addition to the steps S1 to S5 is not reduced to a level that does not interfere with a person or organism, the treated water after the step S6 is returned to the addition treatment tank again, and a series of the decontamination steps S1 to S6 can be performed again. The step S6 can be performed with the first decontamination method as a series of processes by one system (or one apparatus). It may be possible to provide a plurality of the apparatuses connected with each other, each of which can continuously perform the series of decontamination steps, thereby further improving the effect of reducing or eliminating tritium radiation from radioactive contaminated water. Further, it is possible to provide a large scale single apparatus for decontamination treatment, in which the processing time is increased, or a high-pressure pump is used, or a high voltage is applied to a large number of the electrodes in the electrolytic treatment, for example.

In the second decontamination method, a valve 11 of the addition treatment tank is opened to introduce the treated water after the steps S1 to S5 into the electrolytic cell 3 in the allowable amount of the electrolytic treatment capacity of the electrolytic device. In the electrolytic cell, rod-like or plate-like electrodes 31 in the order of 2-30 are arranged. Further, the electrolytic cell is provided with a sensor for detecting whether electric current is not flowing in the electrolytic treatment water (i.e., non-conducting state). The treated water introduced from the addition treatment tank is stored in the electrolytic cell. When electric current is supplied to the electrodes and the current flows into the treated water, the electrolytic treatment is carried out continuously for about 10-30 hours. The number of rod-like or plate-like electrodes may be 4 to 100, depending on the scale of the electrolytic device or the amount of the electrolytic treatment water. When 10 to 100 plate-like electrodes are installed, the electrolytic treatment time can be greatly shortened.

The step S6 is carried out continuously until the electrolytic treatment water in the electrolytic cell reaches the non-conducting state. In the electrolytic cell, a sensor 32 is provided for detecting the non-conducting state of the electrolytic treatment water, that is, a state in which electric current is not flowing in the electrolytic treatment water. The sensor determines whether or not the treated water in the electrolytic cell has reached the non-conducting state. The electrolytic process is performed until a notification of the non-conduction detection is received from the sensor. When receiving the notification of the non-conduction detection, the electrolytic treatment is stopped. The notification from the sensor can be confirmed by a buzzer sound or a lamp lighting.

In the present invention, electrodes made of iron, stainless steel or platinum can be used as the electrodes 31 arranged in the electrolytic cell. Further, these electrodes can be mixed in the electrolytic cell, that is, a combination of the iron electrodes and the stainless steel electrodes, a combination of the iron electrodes and the platinum electrodes, a combination of the stainless steel electrodes and the platinum electrodes, or a combination of the iron electrodes, the stainless steel electrodes and the platinum electrodes can be arranged in the electrolytic cell. When the electrodes in a total of 30 pieces are arranged, for example, 10 iron electrodes, 10 stainless steel electrodes, and 10 platinum electrodes are alternately arranged in the electrolytic cell so that the state in which the current does not flow in the treated water in the electrolytic cell, in other words, the time until the electrolytic cell reaches the non-conducting state can be shortened.

The electrolytic treatment is carried out by applying an AC current of 100 to 500 V to the electrodes. An alternating current of 200 V or more may be applied to the electrodes to greatly shorten the electrolytic treatment time, depending on the scale of the apparatus or the amount of electrolytic treatment water. Further, the electrolytic treatment may be repeated until the desired tritium radioactive concentration is obtained. Similarly to the first decontamination method, the electrolytic treatment is repeatedly carried out until the level of the tritium concentration reaches the level in which the safety of discharge to the sea or river is secured or the level in which the agreement of local residents is obtained.

The addition of the mineral powder PM to the addition treatment tank 1 is carried out by pushing the mineral powder PM to the addition treatment tank while the stirring device is agitating. The mineral powder is added to the contaminated water by, for example, pushing the mineral powder into the addition treatment tank, while being agitated by, for example, a screw-type agitator. The decontamination method according to the present invention may also be used for decontamination of cesium, strontium and other radioactive materials.

Example 1

The tritium sample solution (H-3) provided from the Japan Radioisotope Association as a public non-profit organization was subjected to pretreatment by a distillation operation, and the tritium concentration analysis was performed by KAKEN CO., LTD.

Measurement Vessel: 20 ml (liter) Low potash glass vial
Pretreatment: In view of a normal pressure distillation method described in "Tritium Analysis Method", No. 9 of Radiation Measurement Method Series by Ministry of Education, Culture, Sports, Science and Technology in Japan, a measurement sample (distilled water) was prepared. 1.0 mL of the measurement sample was divided into the measurement vessel, and 9 mL (milliliter) of purified water was added. Further, 10 ml of Ultima Gold LLT as a scintillator was added. Then, the mixture was stirred and mixed.

1.34 mL of tritium was mixed and stirred with 50 L (liter) of purified water to obtain test water for demonstration test (hereinafter referred to as "test water"). The first decontamination method using the test water as tritium radioactive contaminated water for use in the present invention whose tritium radioactive concentration was 1031±2 Bq/mL was carried out by KAKEN CO., LTD.

Demonstration Test Date: Sep. 3, 2019

Measurement Date: Sep. 11, 2019

Analyzer: Liquid Scintillation Counter (Tri-Carb 3110TR of Perkin Elmer)

Analysis method: The pretreated measurement sample, purified water and Ultima Gold LLT were stirred and mixed. After mixing, the mixture was left in a cool dark place for one day or more and stabilized, and then measured by the liquid scintillation counter for 30 minutes. The background correction was performed to calculate the radioactive concentration.

100 g (glam) of black silica powder and 100 ml of KMK carbon liquid (registered trademark) were added (S1) to about 50 L of the test water (tritium radioactive contaminated water) at about 45.8° C. charged into the addition treatment tank, and the mixture was stirred for about 30 minutes in the addition treatment tank. Thereafter, the same amount of the powder and the carbon liquid were added to the test water, and mixed and stirred for about 30 minutes. The addition treated water with the powder and the carbon liquid were pumped (S2) into and passed through (S3) the mineral solid filled tank filled with the black silica ore crushed to a size of about 3 cm from the addition treatment tank, using the hydraulic pump of about one atmospheric pressure. The passed treated water was returned (S4) to the addition treatment tank by the hydraulic pump. After pumping to the mineral solid filled tank (S2), passing through the mineral solid filled tank (S3) and returning to the addition treatment tank (S4), the series of processing steps S2 to S4 were repeated for 60 minutes (S5).

As a result of measuring the tritium radioactive concentration, the treated water obtained by the series of the steps indicated 927±2 Bq/mL. While the tritium radioactive concentration of the original test water indicated 1031±2 Bq/mL, the tritium radioactive concentration of the test water decontaminated using the first decontamination method indicated 927±2 Bq/mL, which provided about 10.1% reduction of the radioactive concentration after decontamination treatment. It can be seen that the tritium radioactive concentration was significantly attenuated.

Example 2

3 L (liter) of the treated water taken out of the decontamination treated water, for which the series of the steps S1 to S5 in Example 1 were carried out, were subjected to the electrolytic treatment as the second decontamination of the present invention. The tritium radioactive concentration of the treated water after the electrolytic treatment was analyzed by KAKEN CO., LTD. The above-mentioned pretreatment, preparation of the test water, the analyzer, the analysis method, the tritium radioactive concentration analysis etc. were performed in the same manner as for Example 1.

Demonstration Test Date: Aug. 18, 2019

Measurement Date: Aug. 26, 2019

While an AC current of 100 V was applied to the two bar-like electrodes of the electrolytic cell, 3 L of treated water to which the respective steps of Example 1 were carried out was subjected to the electrolytic treatment for about 24 hours until lighting of the sensor in the electrolytic cell indicated the electrolytic treated water became in the non-conducting state, that is, a state in which the current was not flowing in the electrolytic treated water.

As a result of measuring the tritium radioactive concentration, the electrolytic treated water subjected to the electrolytic treatment indicated 864±2 Bq/mL. Compared to the tritium radioactive concentration of the original test water, the radioactive concentration after the treatment was reduced by about 16.5%. It can be seen that the tritium radioactive concentration was significantly attenuated.

Considering the decontamination effect according to the present invention, it is believed that based on the encapsulating effect on the radioactive material by the KMK carbon liquid (registered trademark), as well as absorbing effect of the electromagnetic wave of the radioactive material by the KMK carbon liquid to radiate it as thermal energy, tritium is converted to natural world calcium or carbon dioxide (CO2) or helium-3 as the fixed ore (rock) of the inorganic substance, and the radiation is attenuated. It is also believed that the complex action such as the electrolytic treatment, ion exchange, far-infrared generation or high-voltage current generation in the series of the processing steps promotes beta-collapse of atomic cores of the radioactive material and changes the tritium to the natural world calcium or carbon dioxide (CO2) or helium-3 or other substances as the fixed ore (rock) of the inorganic substance.

INDUSTRIAL APPLICABILITY

The decontamination method according to the present invention can realize decontamination of contaminated water, especially tritium-contaminated water, which has been difficult to decontaminate, by using the easily available mineral or the carbon liquid. The decontamination method according to the present invention achieves treatment of the radioactive contaminated water generated due to an accident of a facility or a storage facility for performing treatment or the like for the radioactive materials or a natural disaster or the like, or treatment of the radioactive contaminated water generated from contaminated soil, incineration ash or the like. Therefore, it is expected to be widely used in radioactive decontamination treatment.

DESCRIPTION OF REFERENCE NUMERALS

S1: addition treatment step
S2: pumping treatment step into mineral solid filled tank
S3: passing treatment step through mineral solid filled tank
S4: returning treatment step to addition treatment tank
S5: circulation process of repeating steps S2 to S4
S6: electrolytic treatment step
1: addition treatment tank
2: mineral solid filled tank
3: electrolytic tank
11: valve
31: electrodes
32: sensor
RCW: tritium radioactive contaminated water
PM: mineral powder
PMT: mineral powder storage tank
LC: nano-level carbon liquid
LCT: nano-level carbon liquid storage tank
P: hydraulic pump
SM: mineral solid

What is claimed is:

1. A tritium radioactive contaminated water decontamination method of reducing or removing tritium radiation from radioactive contaminated water, the method comprising the steps of:

a first step of performing an addition treatment in an addition treatment tank, the addition treatment including adding 0.5-6 parts by weight of a mineral powder obtained by pulverizing a mineral comprising one or more selected from silicon dioxide ore, old shellfish fossil and radium ore, and 0.5-6 parts by weight of a nano-level carbon liquid to 100 parts by weight of tritium radioactive contaminated water heated to 30-80° C.;

a second step of pumping the addition treated water from the addition treatment tank to a mineral solid filled tank by a hydraulic pump of 1 to 7 atmosphere pressure, the mineral solid filled tank being filled with a mineral solid in which the mineral is crushed to a predetermined size;

a third step of passing the pumped addition treated water through the mineral solid filled tank, while the pumped addition treated water is colliding with the mineral solid;

a fourth step of returning the treated water passed through the mineral solid filled tank to the addition treatment tank by the hydraulic pump; and, a fifth step of performing a circulation process of repeating the second to fourth steps for 20 to 80 minutes.

2. The tritium radioactive contaminated water decontamination method according to claim 1, wherein the first to fifth steps are performed for 10-60 minutes, and thereafter, the mineral powder and nano-level carbon liquid addition treatment in the first step of adding 0.5-6 parts by weight of the mineral powder and 0.5-6 parts by weight of the nano-level carbon liquid to 100 parts by weight of the tritium radioactive contaminated water is further performed, and thereafter, the second to fifth steps are performed for 10-60 minutes.

3. The tritium radioactive contaminated water decontamination method according to claim 1, wherein a series of the first to fifth steps are repeated until a desired tritium radioactive concentration is obtained.

4. The tritium radioactive contaminated water decontamination method according to claim 1, further comprising:

a sixth step of introducing a predetermined amount of a decontamination treatment water to which a series of the first to fifth steps are executed into an electrolytic cell in which 2-30 rod-like or plate-like electrodes are arranged and performing electrolytic treatment for 10-30 hours.

5. The tritium radioactive contaminated water decontamination method according to claim 4, wherein the electrolytic treatment is carried out until electrolytic treatment water in the electrolytic cell reaches a non-conducting state.

6. The tritium radioactive contaminated water decontamination method according to claim 4, wherein the electrodes arranged in the electrolytic cell are two or three selected from iron electrodes, stainless steel electrodes and platinum electrodes.

7. The tritium radioactive contaminated water decontamination method according to claim 4, wherein the electrolytic treatment is carried out by applying an alternating current of 100 to 500 V to the electrodes.

8. The tritium radioactive contaminated water decontamination method according to claim 4, wherein the electrolytic treatment is repeatedly performed until a desired tritium radioactive concentration is obtained.

9. The tritium radioactive contaminated water decontamination method according to claim 1, wherein the mineral powder is agitated by a stirring device and extruded into the addition treatment tank.

10. The tritium radioactive contaminated water decontamination method according to claim 2, wherein a series of the first to fifth steps are repeated until a desired tritium radioactive concentration is obtained.

11. The tritium radioactive contaminated water decontamination method according to claim 2, wherein the mineral powder is agitated by a stirring device and extruded into the addition treatment tank.

12. The tritium radioactive contaminated water decontamination method according to claim 2, further comprising:

a sixth step of introducing a predetermined amount of a decontamination treatment water to which a series of the first to fifth steps are executed into an electrolytic cell in which 2-30 rod-like or plate-like electrodes are arranged and performing electrolytic treatment for 10-30 hours.

13. The tritium radioactive contaminated water decontamination method according to claim 12, wherein the electrolytic treatment is carried out until electrolytic treatment water in the electrolytic cell reaches a non-conducting state.

14. The tritium radioactive contaminated water decontamination method according to claim 12, wherein the electrodes arranged in the electrolytic cell are two or three selected from iron electrodes, stainless steel electrodes and platinum electrodes.

15. The tritium radioactive contaminated water decontamination method according to claim 12, wherein the electrolytic treatment is carried out by applying an alternating current of 100 to 500 V to the electrodes.

16. The tritium radioactive contaminated water decontamination method according to claim 12, wherein the electrolytic treatment is repeatedly performed until a desired tritium radioactive concentration is obtained.

* * * * *